United States Patent [19]

Hammond

[11] 4,375,710

[45] Mar. 8, 1983

[54] ROLLER SUPPORTING MEANS FOR LONG RETRACTING SOOTBLOWERS

[75] Inventor: Charles W. Hammond, Lancaster, Ohio

[73] Assignee: The Babcock & Wilcox Company, New Orleans, La.

[21] Appl. No.: 300,933

[22] Filed: Sep. 10, 1981

[51] Int. Cl.[3] ..... F23J 3/02

[52] U.S. Cl. ..... 15/316 R

[58] Field of Search ..... 15/316 R, 316 A, 317, 15/318

[56] References Cited

U.S. PATENT DOCUMENTS 3,604,050 9/1971 Nelson et al. ..... 15/317

4,207,648 6/1980 Sullivan et al. ..... 15/316 R

FOREIGN PATENT DOCUMENTS 2162498 6/1973 Fed. Rep. of Germany .... 15/316 R

*Primary Examiner*—Chris K. Moore

*Attorney, Agent, or Firm*—Harness, Dickey & Pierce

[57] ABSTRACT

Roller-type supporting means is disclosed herein for the lance tube of a long retracting sootblower. An assembly of four rollers is mounted in a cradle structure rockable about an axis transverse to the beam of the sootblower and also swingable about a vertical axis radial to the lance tube axis. The sides of the cradle structure are defined by rocker arms capable of limited independent rocking movement. The rollers are laterally and longitudinally spaced from each other and underengage and support the lance tube. The points of engagement between the rollers and the lance tube lie approximately in a common plane which also includes said transverse axis.

14 Claims, 7 Drawing Figures

FIG. 1.
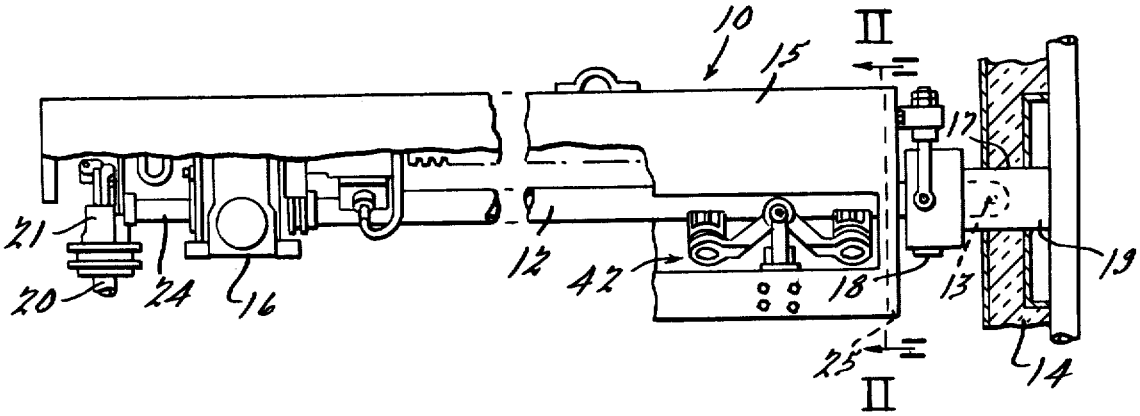
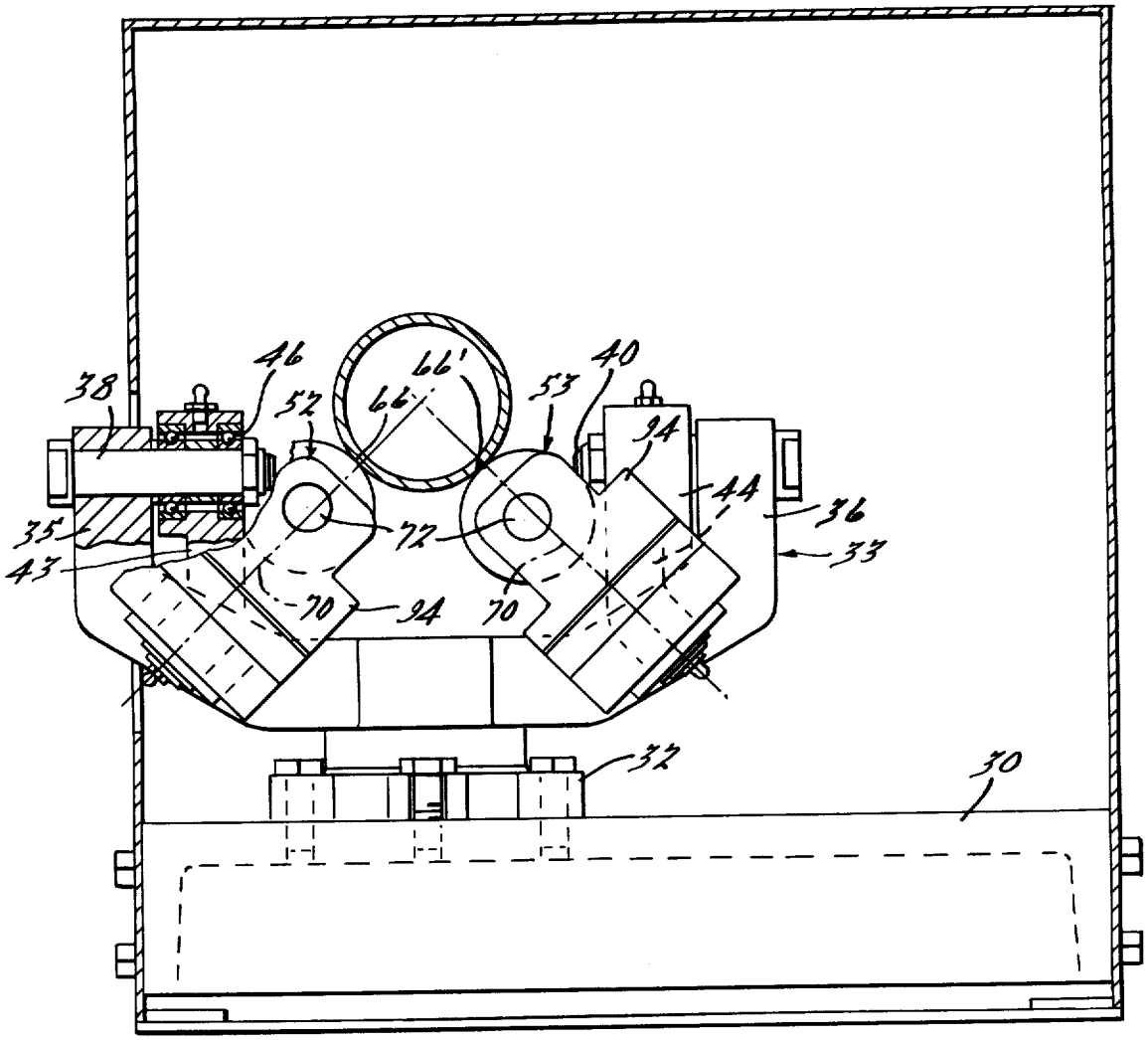
FIG. 2.

ROLLER SUPPORTING MEANS FOR LONG RETRACTING SOOTBLOWERS

BACKGROUND OF THE INVENTION

Typically, long travel sootblowers are equipped with two support rollers located at the front or boiler end of the sootblower (see for example U.S. Pat. No. 3,585,673, granted June 22, 1971). The function of these rollers is to support the lance tube in a vertical plane and to control and limit its lateral motion in a horizontal plane. With the sootblower in its fully retracted position, only a short length of the lance tube extends beyond the front rollers toward the boiler, and the lance tube is then supported at its back end by the carriage and near its front end by the front support rollers. In this position, the load on the front rollers is at a minimum. As the carriage is moved forward, thus projecting the lance tube into the boiler, the load on the front rollers steadily increases until with the lance tube fully extended the load is maximum.

As the lance tube progresses from the fully retracted to the fully extended position the radius of curvature of that portion of the lance tube which is bearing on the front rollers is constantly changing as is the location of the center of the radius of curvature, both in a vertical and horizontal plane.

With the increasing size of boilers it has been necessary to construct sootblowers having longer and longer travel, some lance tubes being required to extend into a boiler distances exceeding 50 feet. As a result of such increased lance tube weight and the heavy overbalanced loads developed by the lance tubes of such blowers when extended, front roller assemblies are required to carry extreme loads, and the stresses applied to the rollers, bearings and supporting structure, as well as to the lance tube itself and the lance tube driving mechanism, have become very high. It will be recognized that such stresses affect the weight and power factors that must be taken into account in the design of the equipment, and/or the life of the components. While it is possible to somewhat increase the front roller diameters to reduce stresses, the lance tube diameter cannot easily be increased.

The present invention has as its primary objective the provision of an improved multiple roller front supporting structure which greatly reduces the stress concentrations imposed upon the lance tube, rollers and associated parts, which distributes the loads imposed upon the lance tube and which is so designed that the loads are equalized on all of the rollers. A further object is to provide such a construction which maintains uniform distributed loading of the lance tube, rollers and other parts even though the lance tube may have become distorted.

Still another object is to provide such a construction wherein changes in the frictional loads imposed by the rollers and bearings do not affect the uniformity of weight loading imposed by the lance tube on the several rollers.

Other objects and advantages will become apparent upon consideration of the present disclosure in its entirety.

BRIEF DESCRIPTION OF THE FIGURES OF DRAWING

FIG. 1 is a somewhat diagrammatic side elevational view of a sootblower provided with roller supporting means embodying the present invention, the sootblower being partly broken away and a portion of a boiler wall being illustrated in section;

FIG. 2 is a shallow cross-sectional view on a larger scale taken substantially as indicated by the line and arrows designated II—II in FIG. 1;

FIG. 3 is a side elevational view of the roller supporting means and adjacent parts on a larger scale, partly broken away;

DETAILED DESCRIPTION OF PREFERRED FORMS OF THE INVENTION

Figure 5:
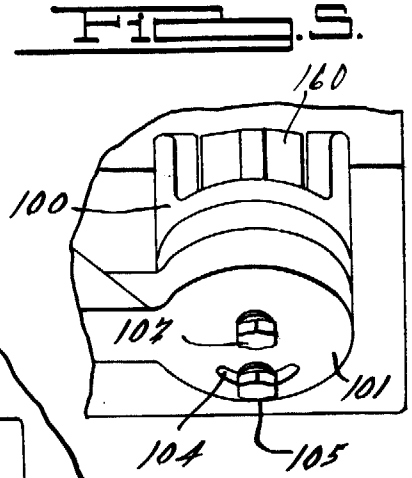
FIG. 5 is a perspective elevational view of a pad and roller carrier bracket of modified construction.

Reference character 10 designates generally a long travel sootblower of the well-known IK type, having a lance tube 12 projectable into the interior of the boiler or other heat exchanger within which surfaces are to be cleaned by the blower. The supporting means includes a beam structure 15 of inverted U cross-section containing track portions (not shown) upon which a carriage 16 is mounted to travel along the beam. The carriage contains a driving motor and suitable gearing, also not illustrated, by means of which the lance tube 12 is drivable both longitudinally and angularly to and from an extended position in which it projects through the wall 14 and into the heat exchanger. Typically, in such extended position the lance tube has no support within the heat exchanger and extends thereinto cantilever fashion for a distance which may exceed 50 feet. At its closed outer end the lance tube is provided with one or more nozzles as 13 through which a cleaning medium is discharged.

The blowing medium, which may be air, steam, water or a mixture of these media, is delivered to a blow control valve 21, also of well known construction, from suitable supply means via a supply pipe 20, and when the valve is open, is delivered to a stationary feed tube 24 upon which the lance tube 12 is slidably and rotationally overfitted. A blower control valve of a suitable construction is disclosed in British Pat. No. 958,005, patented Nov. 6, 1962.

The beam 15 is supported by suitable structural elements (not shown) at a position appurtenant to and projecting outwardly from the wall 14 of the boiler or other heat exchanger. The wall 14 of the boiler fragmentarily illustrated in FIG. 1 has an opening 17 for reception of the sleeve 19 of the wall box 18. During operation, the lance tube is either continuously rotated in one direction during each of its inward and outward traveling movements or, alternatively, is angularly oscillated throughout less than 360° about its longitudinal axis during such longitudinal travel. (See for example U.S. Pat. No. 4,177,539, dated Nov. 28, 1978). The lance tube moves into and from the interior of the heat exchanger through the opening and wall box, the box being shown as of a known air cooled type which provides a substantial seal around the lance tube. (See for example U.S. Pat. No. 2,803,848, granted Aug. 27, 1957).

Sootblower and heat exchanger details described thus far in this section of the specification will be recognized as conventional and well known in the art and have been referred to for the purpose of indicating the environment wherein the invention finds particular utility. They do not in themselves form a part of the present invention. Sootblowers of the general class with which the invention is adapted to be used are illustrated and described in numerous issued patents, including U.S. Pat. No. 2,668,978, dated Feb. 16, 1954; U.S. Pat. No. 3,439,376, dated Apr. 22, 1969; U.S. Pat. No. 3,585,673, dated June 22, 1971; and U.S. Pat. No. 3,604,050, dated Sept. 14, 1971.

It is also common to provide, usually supported by the front bulkhead 25 of the beam 15 of the blower, roller means upon which the lance tube is rollably supported.

The roller supporting means of the present invention comprises a cradle structure generally designated 42, shown as supported from beneath upon a cross channel member 30 attached to the sidewalls of the beam 15. A pedestal 32 bolted to the top of the cross channel supports a yoke member 33 mounted on a stub shaft 34 secured in and projecting vertically from the pedestal. The yoke 33 is rotatable about the stub shaft and has side arms 35, 36 extending transversely and then upwardly therefrom to positions beside the lance tube but slightly below the axis thereof. The upper ends of the arms 35, 36 carry oppositely inwardly projecting coaxial stub shaft 38, 40, respectively, rigidly mounted therein and which provide a trunnion-type support for the cradle assembly.

The cradle assembly, which is rockably carried by the yoke, is comprised of two like but symmetrically opposed rocker arms, 43, 44 centrally pivoted on the respective stub shafts 38, 40. The rocker arms are spaced laterally and equidistantly from the normal axis of the lance tube, and extend longitudinally parallel thereto. Antifriction bearing means as 46 are preferably provided journalling the rocker arms on their respective stub shafts, and each of the rocker arms includes a pair of divergent arms as 47, 48 extending angularly downwardly, forwardly and rearwardly from the pivot axis defined by the stub shafts 38, 40. At the end of each of the arms 47, 48 is an integral rigid pad as 50, 51. Each of the pads is so inclined as to present one face toward the lance tube, lying at 45° to the horizontal, so that a line projected from the center of the pad and perpendicularly thereto is radial to the lance tube.

Each of the pads as 50, 51 pivotally supports a roller carrier bracket (only three of the four pads and carrier brackets being illustrated). The shown carrier brackets are generally designated 52, 53, 54. A roller as 60 is journaled in each of the carrier brackets. The four rollers supported by the rocker arms underlie and rollably support the lance tube. The opposed right and left rollers contact the lance tube at points spaced from each other approximately 90° around the periphery of the lance tube. Such points of contact are designated 66, 66' in FIG. 2. The points of contact between all of the rollers and the lance tube lie in the same (generally horizontal) plane as the trunnion axis defined by the coaxial stub shafts 38, 40. By virtue of this coplanar arrangement, any differences in frictional loads imposed by the rollers or bearings, or by uneven surfaces which may develop on the lance tube, will not interfere with uniform loading of the rollers by the weight of the lance tube.

Figure 4:
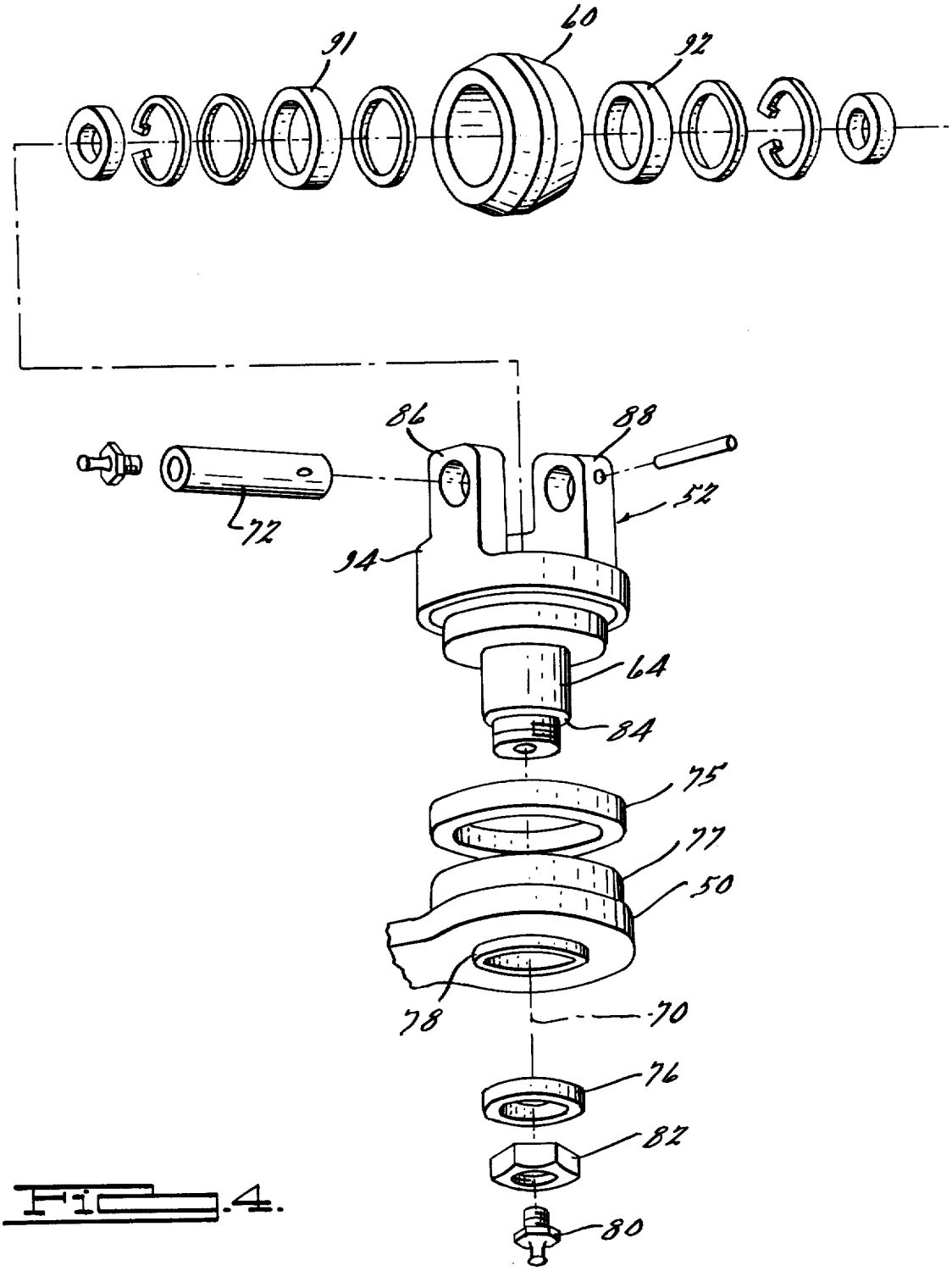
FIG. 4 is an exploded perspective view of one of the roller assemblies and the end pad portion of the rocking beam upon which it is supported.

As best shown in FIG. 4, each of the roller carrier brackets as 52 is journaled in its supporting pad as 50 by means of an intergral stub shaft 64 for rotation about an adjustment axis 70, which in this embodiment of the invention is also a castering axis. Axis 70 is radial with respect to the lance tube 12 and is inclined at approximately 45° to the horizontal. Axis 70 is also positioned substantially centrally of, and projects perpendicularly from, the pad on which the carrier is mounted.

Each roller is journaled on a roller shaft 72 mounted in the side arms 86, 88 of its roller carrier bracket. The axis of each roller shaft 72 is laterally offset from the castering axis 70 sufficiently so that changes in the helix angle such as occur with oscillating blowers cause the roller carrier brackets to turn to and maintain positions wherein their roller shafts are perpendicular to the path of rolling movement, thereby providing a castering action which eliminates sliding of the lance with respect to the rollers. As brought out in FIG. 4 (in which for convenience of illustration the parts are not shown inclined) each roller carrier bracket is journaled by means which includes antifriction bearings 75, 76 above and below the pad 50. The bearings 75, 76 are closely surrounded by walls 77, 78 which project upwardly and downwardly from the pad and assist in shielding the bearings against contamination. The stub shaft 64 projects below the pad and bearings, where it carries a lubricant fitting as 80 and is secured by a nut 82 which when tightened reacts through the lower bearing 76 against a shoulder 84 on stub shaft 64 to secure the roller bracket and permit rotation thereof about the castering axis. The roller is mounted on its shaft 72 on suitable antifriction bearings as 91, 92, conventional washering and securing snap ring means being provided as illustrated in FIG. 4.

In order to eliminate the effect of gravity on the castering action, a counterweight mass sufficient to statically balance the roller and roller carrier bracket assembly with respect to the inclined castering axis is preferably incorporated in each of the roller carrier brackets, on the side opposite that to which the roller axis is offset. The counterweight mass is formed by a heightened wall portion as 94 integral with and interconnecting the two side arm portions 86, 88 and looped around the roller. By virtue of the counterbalancing effect of the mass provided in the heightened wall area, the ability of the roller to adjust its position so as to track accurately without sliding friction remains unaffected by changes of helix angle during operation of the blower.

The longitudinal spacing of the rollers along the axis of the lance tube is so related to the helix angle that the lines of engagement between the several rollers and the lance tube are spaced from one another, none of the rollers engaging the same parts of the lance tube. Preferably the four paths of roller engagement are equally spaced from each other along the lance tube, thereby distributing the loading and minimizing stress on the lance tube.

It will be seen that when the lance tube curves due to sagging as it is projected into the heat exchanger, all four rollers are uniformly loaded, and when the location of the center of curvature moves outwardly or inwardly, the rocker arms 43, 44 are swingable about the supporting stub shafts 38, 40 in the yoke. If, as is frequently encountered in commercial operation of sootblowers, the lance tube becomes somewhat distorted due to the high temperatures within a boiler, the two rocker arms may pivot independently to slightly different angles, and the entire cradle assembly and yoke 33 may also rotate on stub shaft 34 to the extent required to eliminate any binding or friction due to such distortion.

Where the invention is to be incorporated in a non-oscillating blower of the type wherein the lance tube continues to rotate on the same helix continuously in one angular direction during the entire projecting movement, and in the same manner during retracting movement, the supporting rollers may be fixed in an angular position conforming to the helix angle. In such case, as brought out in FIG. 5, the roller bracket (designated 100) is adapted to be fixed at the proper conforming angle. The pads as 101 are provided with an axial opening (undesignated) through which a heavy axial cap screw 102 extends from the bottom into a suitably tapped hole (also undesignated) in the roller carrier bracket 100, no stub shaft corresponding to 64 of FIG. 4 being required. In addition, the pad is provided with an arcuate slot 104 concentric with the axis of screw 102, through which a second locking screw 105 extends into a second tapped hole (undesignated) in the carrier bracket. When the screws 102, 105 are loosened, the roller carrier bracket may be turned to the proper helix angle, whereafter tightening the screws locks the roller as 160 in position. This arrangement for adjusting rollers to and fixing them at a specific helix angle is not claimed per se as a part of this invention, being disclosed in earlier patents including U.S. Pat. No. 3,585,673. However, as in the first embodiment thereof, all four rollers are so positioned that they trace separate and preferably uniformly longitudinally spaced helical paths.

Figure 7:
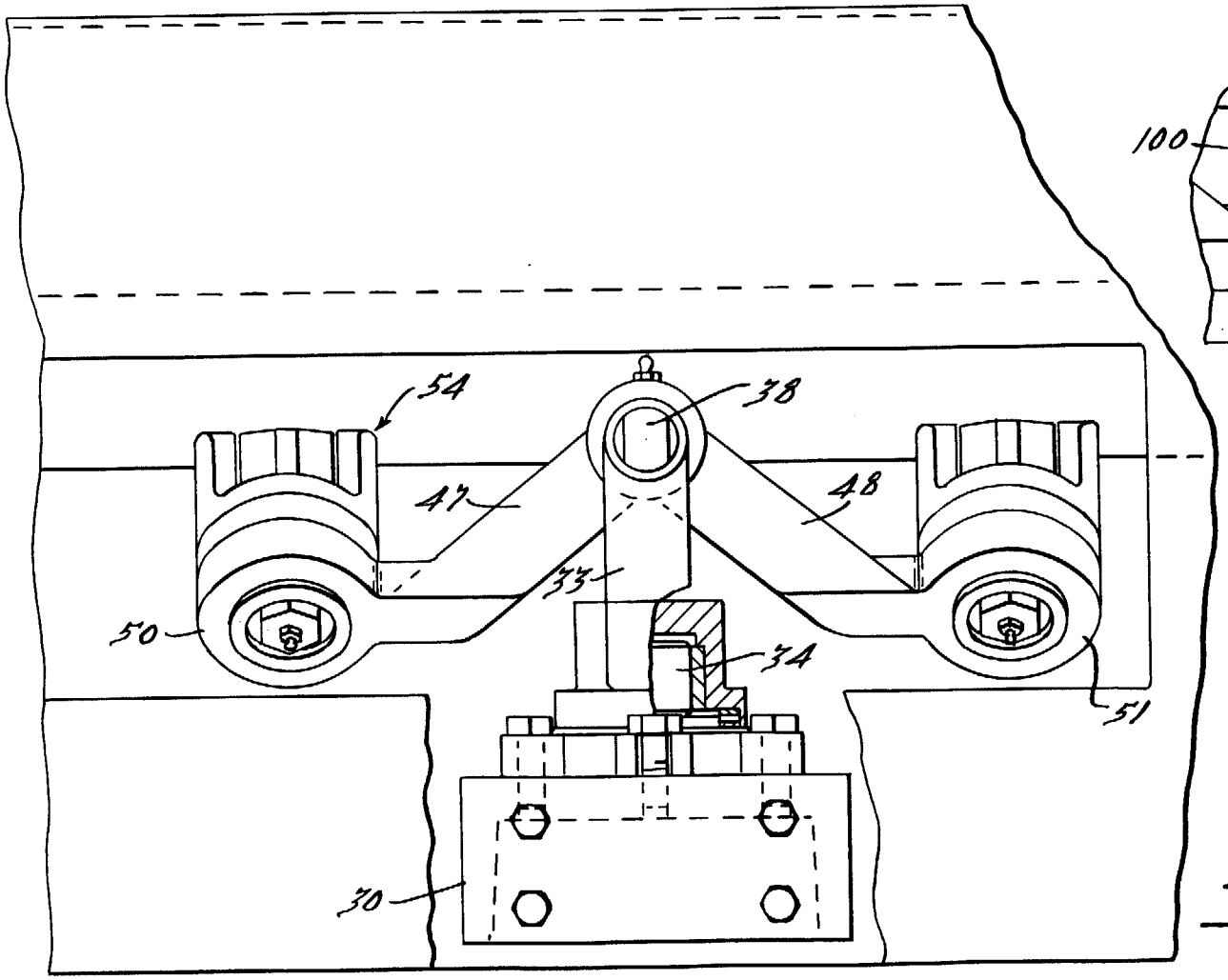
FIG. 7 is an elevational view taken at right angles to FIG. 6, corresponding generally to FIG. 3, showing the modified construction of FIG. 6.
Figure 6:
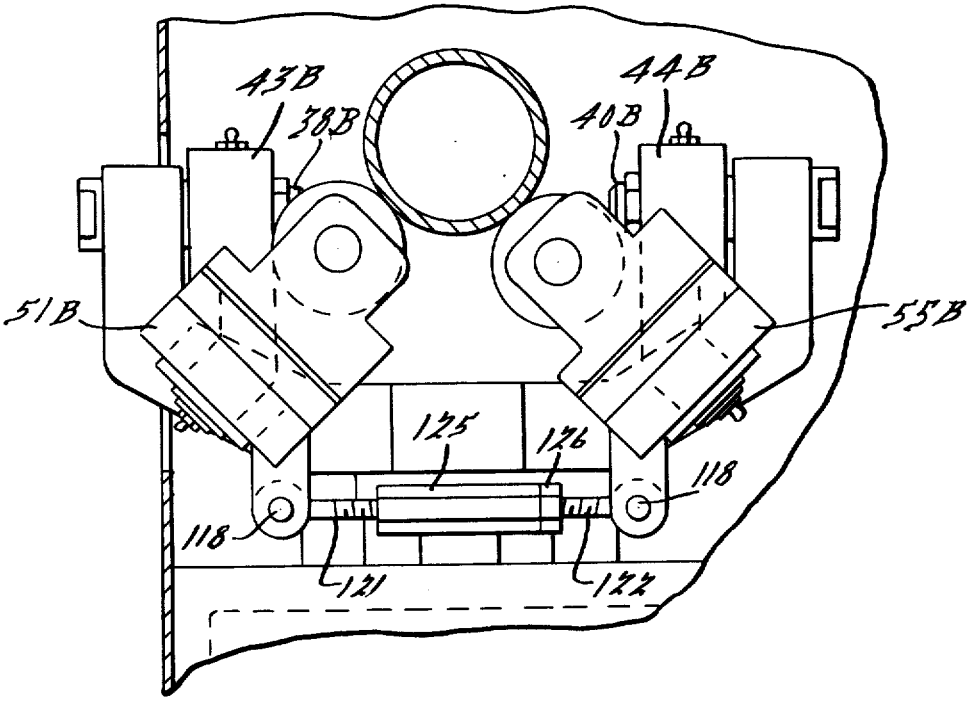
FIG. 6 is a view similar to FIG. 2 illustrating another modified construction, a portion of the beam and supporting means being broken away.
Figure 7:
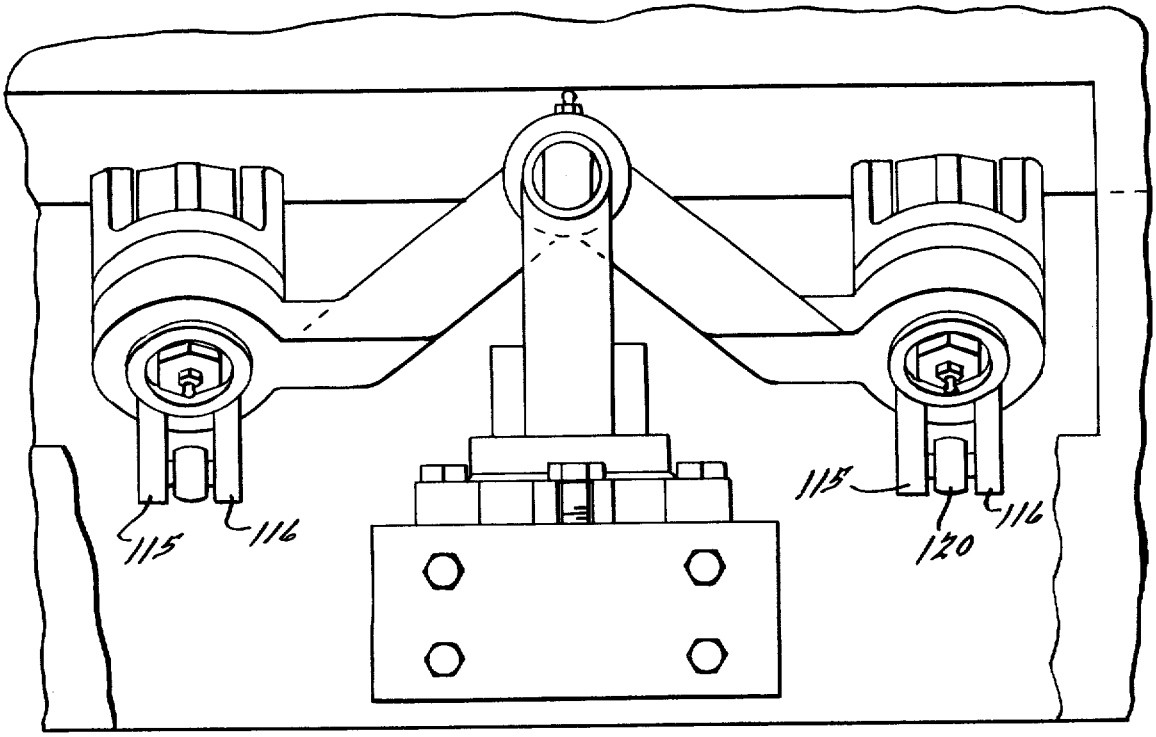

In a further modification shown in FIGS. 6 and 7, wherein parts corresponding to those illustrated in connection with the first described embodiment are designated by like reference characters distinguished by the addition of the letter B, the two front pads 51B, 55B and also the two rear pads, are connected by tying means which permits limited independent vertical movement of the two rocker arms 43B, 44B but opposes any tendency of the arms to separate. Such tying means absorb the spreading force caused by the weight of the lance tube, which force would otherwise impose on the trunnion-type yoke bearings (46, FIG. 2) a rocking couple transverse to the cradle axis defined by shafts 38B, 40B. A pair of lug portions as 115, 116 integral with and projecting downwardly from each of the pads 51B, 55B, etc. supports therein a pivot pin 118 arranged longitudinally of the blower. The eye portion 120 of an eye bolt 121 shown at the left in FIG. 6 is pivoted on the pin 118. A similar eye bolt 122 is mounted in corresponding spaced lug portions carried by the opposite pad as 55B. The machine threads of the eye bolts 121, 122 are reversed, so that a turnbuckle 125 with which both eye bolts are threadedly interengaged can be used to adjust and fix the spacing between the pads. A jam nut 126 is provided on one of the eye bolts to lock the turnbuckle. The opening in the eye of each eye bolt slightly exceeds the diameter of the pivot pin upon which it is mounted, and the spacing between the lugs 115, 116 slightly exceeds the width of the eye bolt, in order to accommodate the slight longitudinal relative displacement of the pads on opposite sides of the cradle structure, which displacement tends to occur if the rocker arms move to slightly different angular positioning as a result of distortion of the lance tube.

It will be recognized that the cradle assembly, rather than being supported from beneath, on a pedestal such as 32, might be supported from above as by a suspended rotatable hanger, and that other changes may be made without departing from the fair and reasonable scope of the appended claims and the properly patentable scope of the invention.

This detailed description of preferred forms of the invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

I claim:

1. In a long travel sootblower including a support comprising a beam, a lance tube carried by the beam for simultaneous longitudinal and angular movement to and from a cantilevered position in which it extends from one end of the beam, and roller means carried by the support appurtenant to said end of the beam for supporting the lance tube in said cantilevered position and during its movement to and from such position, the novel combination which comprises:

a cradle assembly including
- rocker arm portions pivoted on an axis transverse to the beam and
- having end portions spaced lengthwise of the beam from and located on opposite sides of said axis, and
- a pair of rollers on each of said end portions of the cradle assembly,
- said rollers underlying and rollably engaging the lance tube at a plurality of laterally and longitudinally spaced positions.

2. A combination as defined in claim 1 including means supporting said cradle assembly for angular movement about an axis which is substantially vertical and radial with respect to the lance tube.

3. A combination as defined in claim 1 in which there are two laterally spaced rocker arm portions, the axis upon which said rocker arm portions are pivoted being intermediate the length thereof whereby four free end portions of said rocker arm portions are provided, said roller means including a roller on each of said end portions.

4. A combination as defined in claim 3 wherein said rocker arm portions are independently angularly movable about said axis.

5. A combination as defined in claim 3 including means supporting each of said rollers for angular movement about an adjustment axis which is radial to the lance tube and perpendicular to the axis of rolling movement of the roller.

6. A combination as defined in claim 4 including tying means extending between said laterally spaced rocker arm portions and opposing separation thereof.

7. A combination as defined in claim 6 wherein said tying means includes tying elements interconnecting opposed end portions of said rocker arm portions.

8. A combination as defined in claim 7 wherein said tying means permits limited independent movement of said rocker arm portions.

9. A combination as defined in claim 6 wherein said tying means permits limited independent movement of said rocker arm portions.

10. A combination as defined in claim 5 wherein said means supporting the rollers for angular adjustment comprises a carrier bracket for each roller, means which journals each of the rollers in one of said carrier brackets on a rolling axis which comprises the axis of rolling movement of the roller, said axis of rolling movement being offset from said adjustment axis, and means journaling the carrier brackets for free rotation about said adjustment axis, whereby the rollers and carrier brackets are automatically angularly adjustable about said adjustment axis by castering action.

11. A combination as defined in claim 10 wherein the adjustment axes are non-vertical, and counterbalancing means incorporated in said carrier brackets for substantially statically balancing such brackets about the adjustment axes.

12. A long travel sootblower having a cradle assembly as defined in any one of claim 1 to 11 inclusive and wherein the simultaneous longitudinal and angular movement of the lance tube causes all surface portions of the lance tube to move in predetermined parallel helical paths, the rollers being so spaced from one another longitudinally of the lance tube that each roller engages the lance tube on a different helical path.

13. A long travel sootblower having a cradle assembly as defined in any one of claims 1 to 11 inclusive and wherein the simultaneous longitudinal and angular movement of the lance tube causes all surface portions of the lance tube to move in predetermined parallel helical paths, the rollers being so spaced from one another longitudinally of the lance tube that said rollers engage the lance tube on different helical paths that are uniformly spaced from each other longitudinally along the lance tube.

14. A combination as defined in any one of claims 1, 3, 5, 10 or 11 wherein said positions of engagement between the rollers and the lance tube lie substantially in the same plane as said axis transverse to the beam.

* * * * *